United States Patent [19]

Flores

[11] Patent Number: 4,499,399

[45] Date of Patent: Feb. 12, 1985

[54] ANTI-POLLUTANT SPARK PLUG ADAPTOR

[76] Inventor: Manuel Flores, 1208 Lee St., Marrero, La. 70072

[21] Appl. No.: 406,496

[22] Filed: Aug. 9, 1982

[51] Int. Cl.[3] ..... H01T 13/00; F02B 19/18

[52] U.S. Cl. ..... 313/143; 123/266; 123/280

[58] Field of Search ..... 313/143; 123/266, 280, 123/286, 169 PA

[56] References Cited

U.S. PATENT DOCUMENTS

| | | | |
|---|---|---|---|
| 2,826,187 | 3/1958 | Meyer | 123/266 X |
| 3,892,991 | 7/1975 | Joslyn | 313/143 X |
| 4,123,998 | 11/1978 | Heintzelman | 313/143 X |
| 4,182,281 | 1/1980 | Heintzelman | 313/143 X |

FOREIGN PATENT DOCUMENTS

| | | | |
|---|---|---|---|
| 2505696 | 8/1976 | Fed. Rep. of Germany PA | 123/169 |
| 2657416 | 12/1977 | Fed. Rep. of Germany | 123/266 |

*Primary Examiner*—Palmer Demeo

*Attorney, Agent, or Firm*—Keaty & Keaty

[57] ABSTRACT

A spark plug adaptor for an internal combustion engine is provided with two chambers, an upper preliminary chamber and a lower secondary chamber. The upper chamber encompasses the spark plug electrodes and communicates with the lower chamber through an acceleration orifice. The lower chamber has a deflector means for imparting turbulence to the combustion products from the upper chamber.

5 Claims, 5 Drawing Figures

ANTI-POLLUTANT SPARK PLUG ADAPTOR

BACKGROUND OF THE INVENTION

1. Field of the Invention

The present invention relates to improvements in a spark plug adaptor for internal combustion engines, wherein said spark plug adaptor is provided with air cooling means, acceleration orifice below the preliminary combustion chamber, and deflector means below said acceleration orifice for imparting turbulence to the accelerated, preliminary combustion products.

2. Description of the Prior Art

A number of spark plug adaptors are known in the prior art. See, for example, U.S. Pat. Nos. 1,320,115; 1,357,661; 3,710,764, and 3,926,156; 2,826,187; 4,256,071; 4,182,281. Only U.S. Pat. No. 4,182,281, entitled "Spark Plug Adaptor and Process," issued to Leo Atintzelman, however, teaches of deflector means integral to the adaptor. However, the present invention is an improvement over U.S. Pat. No. 4,182,281 in the following respects:

a. the present invention features a plurality of air cooling slots provided external to the portion of the adaptor which forms the preliminary combustion chamber;

b. the present invention features a narrow acceleration orifice connecting the preliminary combustion chamber with a secondary chamber;

c. the present invention features a deflector member disposed below said acceleration orifice and perpendicular to said secondary chamber, for imparting turbulence to the accelerated preliminary combustion products as they pass into the internal combustion engine, thereby maximizing the dispersion of the preliminary combustion products, thereby resulting in optimal combustion thereof because of a more complete and uniform mixing, of fuel and air, ultimately resulting in a production of uniform and complete ignition in the combustion chamber, which increases combustion speed, with the benefit of reduced emission of unburned hydrocarbons, carbon monoxide and oxides of nitrogen, which are atmospheric pollutants. Thusly, engine performance is improved and greater fuel efficiency results (i.e. more m.p.g.). Note that the present invention advances the state of the art by means of disposing the deflector member, which is integral to the lower end of the adaptor, below the acceleration orifice and the secondary combustion chamber, thereby resulting in the broadest possible dispersion of the accelerated preliminary combustion products directly before entering the internal combustion engine. U.S. Pat. No. 4,182,281, for example, provides a restricted acceleration orifice below the deflector member in direct communication with the internal combustion engine, thereby resulting in less than maximum dispersion of the preliminary combustion products as they pass into the internal combustion engine. The advantage of the present invention over U.S. Pat. No. 4,182,281 is that the present invention more broadly disperses the preliminary combustion products as they enter into the internal combustion engine, thereby producing a more complete ignition of the preliminary combustion products, thereby producing uniform and complete ignition which increases the combustion speed, with reduced emission of unburned hydrocarbons which are atmospheric pollutants, and also, therefore, improving fuel efficiency (i.e. more m.p.g.).

Other objects and advantages of the present invention will become apparent in the following detailed description when taken in conjunction with the accompanying drawings.

DETAILED DESCRIPTION OF THE PREFERRED EMBODIMENT

Figure 1:
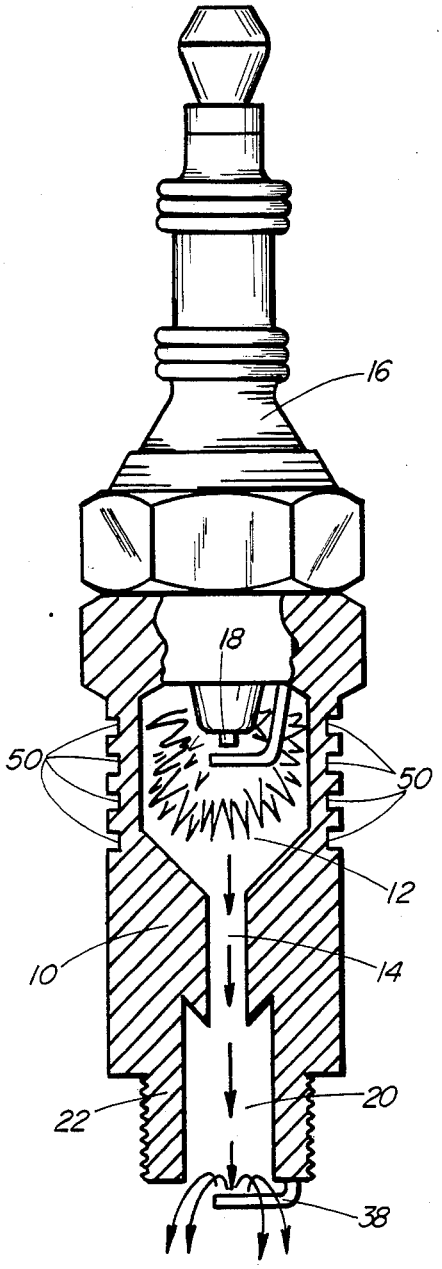
FIG. 1 is an elevational , cross-sectional view of a spark plug with the apparatus of the present invention mated thereinto.

Referring now to the drawings, particularly to FIG. 1, there is shown the form of the invention comprising a generally tubular member 10, internally threaded at its top end to receive the spark plug 16 and the spark gap 18 thereof. Tubular member 10 is provided with a large upper chamber 12 and a slightly smaller lower chamber 20, connected by narrow acceleration orifice 14. Tubular member 10 further comprises a narrower, lower portion 22 which is externally threaded for mating into a spark plug-receiving bore 24 of internal combustion engine 26, as seen in FIGS. 2–5. Upper chamber 12 surrounds the spark gap 18 and lower chamber 20 opens into the internal combustion engine 26. A relatively narrow transverse member 38, fixably attached, preferably, to the bottom end of tubular member 10, extends substantially diametrically across the lower chamber 20 of tubular member 10.

Further, tubular member 10 is provided with a plurality of external air cooling slots 50 in surrounding relationship to upper chamber 12, or preliminary combustion chamber 12. Bottom chamber 20 shall be hereinafter referred to as secondary chamber 20, and transverse member 38 shall be hereinafter referred to as deflector element 38.

Figure 2:
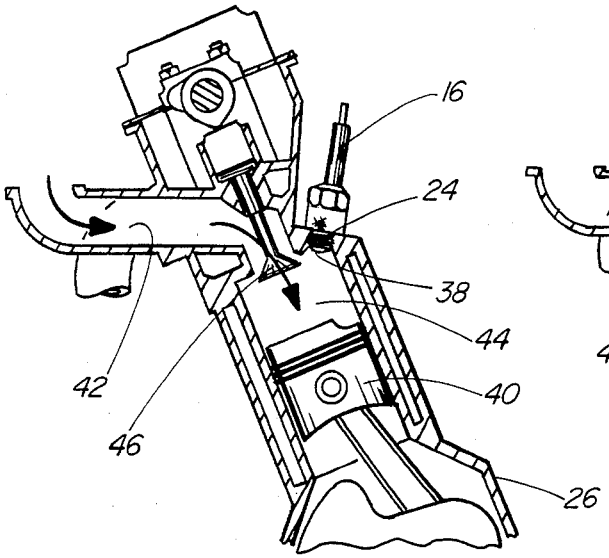
FIG. 2 is an elevational, cross-sectional view of the valving spark plug and piston-and-cylinder portion of an internal combustion engine upon the downstroke of the piston.
Figure 3:
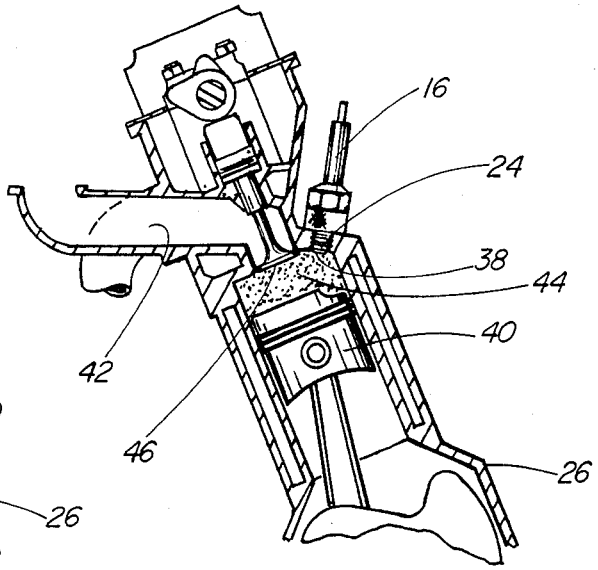
FIG. 3 is the same as FIG. 2, except with the piston shown during the compression stroke.
Figure 4:
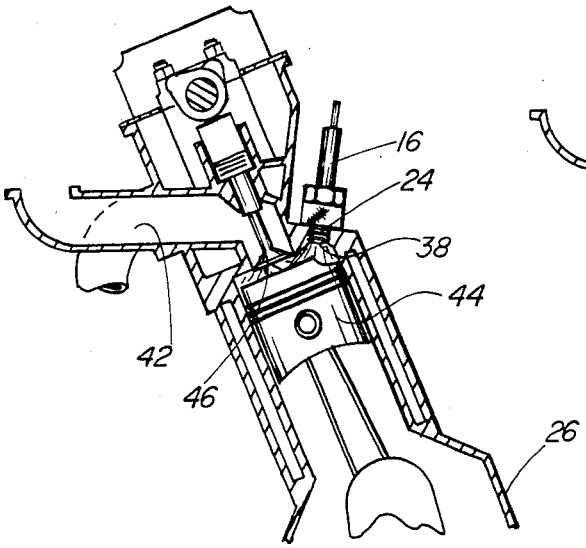
FIG. 4 is the same as FIG. 3, except that the piston is shown upon the completion of the compression stroke.

In operation, the following occurs:

1. As seen in FIG. 2, upon the downstroke of the piston 40, a fuel/air mixture enters from the carburetor (not shown) through the passage 42 into the primary combustion chamber 44 of the internal combustion engine 26, with valve 46 in its open position;

2. As the piston 40 is near completion of its compression stroke, as seen in FIG. 3, the valve 46 goes into its closed position, thereby blocking the flow of the fuel/air mixture from the carburetor (not shown) through the passage 42 into the primary combustion chamber 44;

3. Upon completion of the compression stroke of the piston 40, as seen in FIG. 4., with the valve 46 remaining in its closed position, the fuel/air mixture from the carburetor (not shown) is forced into the preliminary combustion chamber 12 of the tubular member 10, and simultaneously, spark is emitted through spark plug 16 across spark gap 18, thereby preliminarily combusting this fuel/air mixture, within preliminary combustion chamber 12, and the heat caused by this combustion of the fuel/air mixture is partially dissipated from preliminary combustion chamber 12 through the air cooling slots 50 because of the increased surface area thereby formed on the part of tubular member 10 in surrounding relationship to preliminary combustion chamber 12. This partial dissipation of heat from preliminary combustion chamber 12 prevents overheating of the chamber, which overheating can ultimately cause premature combustion (i.e. before the compression stroke is fully completed), or pre-ignition, which condition can seriously impair engine performance (i.e. engine knocking) particularly in the high-performance engines, such as, but not limited to of course, aircraft engines and sports car engines.

Figure 5:
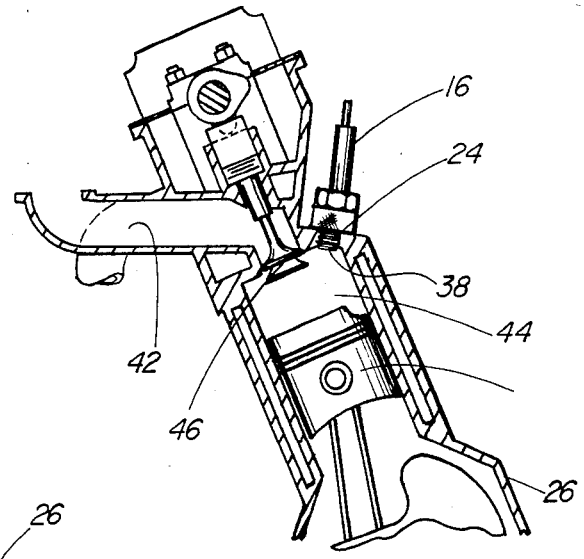
FIG. 5 is the same as FIG. 4, except that the piston is shown in the power stroke position.

4. As seen in FIG. 5, upon the power stroke of piston 40, with the valve 46 remaining in its closed position, the preliminary combustion products are induced through the acceleration orifice 14, thereby accelerating or jetting the preliminary combustion products through the secondary chamber 20 in which a swirling effect occurs, thereby resulting in a more complete mixture of the preliminary combustion products, and around the deflector element 38 which spreads or broadly disperses the preliminary combustion products into the primary combustion chamber 44 of the internal combustion engine 26, thereby resulting in the most complete mixture and broadest possible dispersion of air/fuel heretofore possible and the most complete combustion thereof because of the dispersion within the primary combustion chamber 44, resulting in the maximum possible stroke of the piston 40 downwardly within the primary combustion chamber 44, ultimately producing maximum mechanical energy to turn the crankshaft (not shown) of the internal combustion engine 26. The overall result is that due to the greater and more uniform combustion of the fuel/air mixture, combustion speed is increased accompanied by reduced emission of unburned hydrocarbons, such as carbon monoxide and oxides of nitrogens, which are atmospheric pollutants, and fuel efficiency is increased (i.e. more m.p.g.).

It is to be understood that the invention is not to be limited to the exact details of operation or structure shown and described, as obvious modifications and equivalents will be apparent to one skilled in the art.

What is claimed as invention is:

1. A spark plug adaptor apparatus for an internal combustion engine, comprising:

a. a tubular member having an enlarged upper portion internally threaded to receive spark producing means and a smaller lower portion externally threaded and adapted for threading into a spark-plug receiving bore of the internal combustion engine;

b. an internal central conduit of said tubular member defining an upper preliminary combustion chamber, which houses a spark-producing means of said spark plug, and a acceleration orifice with said upper chamber and which communicates with a primary combustion chamber of said internal combustion engine;

c. a deflector means disposed below said secondary chamber for imparting turbulence to the preliminary combustion products;

d. air cooling means integral to said upper portion of said tubular member for dissipating heat from said preliminary combustion chamber surrounding said spark-producing means of said spark plug.

2. The apparatus of claim 1, wherein said deflector means comprises a transverse member integral to the lower end of said smaller, lower portion of said tubular member.

3. The apparatus of claim 2, wherein said transverse member is integral to the lower end of said smaller, lower portion of said tubular member, and disposed at a 90° angle thereto, and extending substantially diametrically across said tubular member.

4. The apparatus of claim 3, wherein said air cooling means comprises a plurality of slots external to said upper portion of said tubular member in surrounding relationship to said preliminary combustion chamber, thereby increasing the external surface area surrounding said preliminary combustion chamber for maximizing dissipation of heat from said preliminary combustion chamber.

5. A spark plug adaptor apparatus for an internal combustion engine, comprising:

a. a tubular member having an enlarged upper portion internally threaded to receive a spark-producing means of said spark plug and a smaller lower portion externally threaded and adapted for threading into a spark plug receiving bore of the internal combustion engine;

b. an internal central conduit of said tubular member defining an upper preliminary combustion chamber, which houses a spark-producing means of said spark plug, and a smaller, lower secondary chamber, which communicates through an acceleration orifice with said upper chamber and which communicates with a primary combustion chamber of said internal combustion engine;

c. a transverse member integral to the lower end of said smaller, lower portion of said tubular member and disposed perpendicularly thereto and extending substantially diametrically across said tubular member;

d. a plurality of air cooling slots external to said upper portion of said tubular member in surrounding relationship to said preliminary combustion chamber, thereby increasing the external surface area surrounding said preliminary combustion chamber, for maximizing dissipation of heat from said preliminary combustion chamber.

* * * * *